US006114034A

United States Patent [19]

Jorkasky, II et al.

[11] Patent Number: 6,114,034

[45] **Date of Patent: *Sep. 5, 2000**

[54] MELT SPUN ACRYLONITRILE OLEFINICALLY UNSATURATED FIBERS AND A PROCESS TO MAKE FIBERS

[75] Inventors: Richard J. Jorkasky, II, Hudson; Lawrence E. Ball, Akron; Muyen M. Wu, Hudson; Curtis E. Uebele, Hinckley, all of Ohio

[73] Assignee: The Standard Oil Company, Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/780,754

[22] Filed: Jan. 8, 1997

Related U.S. Application Data

[62] Division of application No. 08/574,213, Dec. 18, 1995, abandoned.

[51] Int. Cl.[7] ..... D02G 3/00

[52] U.S. Cl. ..... 428/364; 428/359; 428/375; 428/394

[58] Field of Search ..... 428/364, 375, 428/394, 359

[56] References Cited

U.S. PATENT DOCUMENTS

| | | | |
|---|---|---|---|
| 2,692,875 | 10/1954 | Weinstock, Jr. et al. . | |
| 3,379,699 | 4/1968 | Stroh . | |
| 4,107,252 | 8/1978 | Richmond | 264/176 |
| 4,294,884 | 10/1981 | Bach et al. | 428/364 |
| 4,418,176 | 11/1983 | Streetman et al. | 525/57 |
| 4,446,206 | 5/1984 | Fester et al. | 428/364 |
| 4,524,105 | 6/1985 | Streetman et al. | 428/364 |
| 4,810,448 | 3/1989 | Reinehr et al. | 264/7.13 |
| 4,861,659 | 8/1989 | Takada et al. | 428/364 |
| 4,873,142 | 10/1989 | Back | 428/364 |
| 4,952,453 | 8/1990 | Uchida | 428/364 |
| 5,130,195 | 7/1992 | Sampanis et al. | 428/364 |
| 5,168,004 | 12/1992 | Daumit et al. | 428/364 |
| 5,434,002 | 7/1995 | Yoon et al. | 428/359 |

FOREIGN PATENT DOCUMENTS

| | | |
|---|---|---|
| 728777 | 8/1996 | European Pat. Off. . |
| 61-069814 | 4/1986 | Japan . |
| 61-160416 | 7/1986 | Japan . |
| 62-062909 | 3/1987 | Japan . |
| 62-078209 | 4/1987 | Japan . |
| 62-085012 | 4/1987 | Japan . |
| 62-268810 | 11/1987 | Japan . |
| 01111010 | 4/1989 | Japan . |
| 01236210 | 9/1989 | Japan . |
| 01266213 | 10/1989 | Japan . |

*Primary Examiner*—William Krynski
*Assistant Examiner*—J. M. Gray
*Attorney, Agent, or Firm*—Joseph DiSalvo; Stephen L. Hensley

[57] ABSTRACT

A high nitrile fiber formed from an acrylonitrile olefinically unsaturated multipolymer which fiber is produced by a waterless, solventless melt spinning process.

12 Claims, No Drawings

MELT SPUN ACRYLONITRILE OLEFINICALLY UNSATURATED FIBERS AND A PROCESS TO MAKE FIBERS

This is a divisional of application Ser. No. 08/574,213 filed Dec. 18, 1995 now abandoned.

BACKGROUND OF THE INVENTION

1. Field of the Invention

The present invention is directed to melt spun high nitrile fibers made from melt processable high nitrile multipolymers. More particularly, the invention relates to melt spun high nitrile oriented fibers made from a high nitrile multipolymer comprised of a polymerized acrylonitrile monomer and at least one polymerized olefinically unsaturated monomer. It is understood that the term multipolymer includes copolymers, terpolymers and multipolymers throughout this specification. It is understood that the term fiber and filaments are interchangeable throughout this specification.

2. Description of the Prior Art

Acrylic and modacrylic fibers are synthetic fibers based on acrylonitrile polymers. Acrylics are high nitrile polymers and are conventionally converted into high nitrile fibers by solvent spinning techniques. Acrylic polymers have insufficient melt stability and excessively high melt viscosities so that the high nitrile polymers cannot be solventless melt spun without decomposition. The acrylic high nitrile polymers degrade at an increasing rate above 150° C. The acrylic polymer further becomes yellow, orange, red and eventually black as it degrades. To avoid these problems, the state-of-the-art conversion of acrylic polymers to high nitrile fibers is by a solvent spinning process or by a melt spinning process with water under high pressure.

The solvent spinning process requires large quantities of toxic solvents which are hazardous to the environment. The solvent spinning process occurs at low spinning speeds with complex and extensive mechanical requirements. Solvent spinning increases energy consumption, labor and environmental problems thus capital and operating costs are high. U.S. Pat. No. 2,692,875 entitled "Methacrylonitrile/Acrylonitrile Copolymers and Fibers Thereof" discloses methacrylonitrile and acrylonitrile copolymers converted into fibers by dissolving the copolymer into a suitable solvent and then spinning it into fibers.

The production of acrylic fibers with a modified cross section or hollow fibers requires very involved process conditions to remove the solvent and retain the cross section of the profiled fiber. U.S. Pat. No. 4,810,448 entitled "Process for the Production of Dry-Spun Polyacrylonitrile Profiled Fibers and Filaments" discloses the production of profiled polyacrylonitrile fibers from solvent by a dry spinning process.

It is advantageous to produce a high nitrile fiber by a melt spinning process which requires no solvent, no water, has high spinning rates and low machinery requirements. Further, it is advantageous to eliminate the steps and costs associated with solvent recovery and the environmental problems associated with solvent use. Furthermore, it is advantageous to produce a high nitrile fiber which is oriented, has high tensile strength, has excellent resistance to ultraviolet light, has low shrinkage, has excellent crimpability and has excellent color. Additionally, it is advantageous to produce a high nitrile uniform and dimensionally stable profiled fiber with any desired cross-section or a high nitrile dimensionally stable hollow fiber. Additionally, it is advantageous to produce a colored fiber by the use of pigments.

SUMMARY OF THE INVENTION

The present invention relates to fibers formed from high nitrile multipolymers and produced by melt spinning the high nitrile multipolymers. The fibers are prepared by a solventless, waterless melt spinning process. The melt spun high nitrile fiber is made from a high nitrile melt processable multipolymer comprising about 50% to about 95% by weight polymerized acrylonitrile monomer and at least one of about 5% to about 50% by weight polymerized olefinically unsaturated monomer.

The present invention further encompasses a process for producing the high nitrile fiber comprising:

a) melt extruding a high nitrile multipolymer in the absence of solvent and in the absence of water;

b) spinning the melted high nitric multipolymer into a high nitrile filament(s) at a temperature higher than the glass transition temperature of the multipolymer; and c) collecting the monofilament or the multiple filaments as a fiber bundle or fiber web.

The present invention further encompasses other processing steps such as orienting the filaments by drawing, heat setting the filaments, relaxing the filaments, texturizing the filament yarn and the like. The resulting fibers may be used in woven or non-woven applications.

The high nitrile fibers of the instant invention have enhanced strength and elongation in the axial direction, high tenacity/strength, excellent ultraviolet resistance, low shrinkage, good colorability, uniformity, crimpability and other desirable characteristics of textile fibers. The high nitrile fibers of the instant invention can be a uniform dimensionally stable, profiled fiber with any desired cross-section, a hollow fiber, and the like. The high nitrile fibers of the instant invention can be pigmented to produce colored fiber.

DETAILED DESCRIPTION OF THE INVENTION

In accordance with the present invention a high nitrile multipolymer is converted into a high nitrile fiber by a solvent-free, water-free, melt spinning process. The discovery that a high nitrile multipolymer comprising an acrylonitrile monomer polymerized with at least one olefinically unsaturated monomer can be melt spun could not be predicted from the prior art. The high nitrile multipolymer comprises about 50% to about 95%, preferably about 75% to about 93% and most preferably about 85% to about 92% of polymerized acrylonitrile monomer, and at least one of about 5% to about 50%, preferably about 7% to about 25% and most preferably about 8% to about 15% polymerized olefinically unsaturated monomer.

The olefinically unsaturated monomer employed in the high nitrile multipolymer is one or more of an olefinically unsaturated monomer with a C=C double bond polymerizable with an acrylonitrile monomer. The olefinically unsaturated monomer employed in the multimonomer mixture can be a single polymerizable monomer resulting in a copolymer or a combination of polymerizable monomers resulting in a multipolymer. The choice of olefinically unsaturated monomer or combination of monomers depends on the properties desired to impart to the resulting high nitrile multipolymer and its fiber end use.

The olefinically unsaturated monomer generally includes but is not limited to acrylates, methacrylates, acrylamide and its derivatives, methacrylamide and its derivatives, maleic acid and derivatives, vinyl esters, vinyl ethers, vinyl amides, vinyl ketones, styrenes, halogen containing monomers, ionic monomers, acid containing monomers, base containing monomers, olefins and the like.

The acrylates include but are not limited to $C_1$ to $C_{12}$ alkyl, aryl and cyclic acrylates such as methyl acrylate, ethyl acrylate, phenyl acrylate, butyl acrylate and isobornyl acrylate, 2-ethylhexyl acrylate and functional derivatives of the acrylates such as 2-hydroxyethyl acrylate, 2-chloroethyl acrylate and the like. The preferred acrylates are methyl acrylate and ethyl acrylate.

The methacrylates include but are not limited to $C_1$ to $C_{12}$ alkyl, aryl and cyclic methacrylates such as methyl methacrylate, ethyl methacrylate, phenyl methacrylate, butyl methacrylate, isobornyl methacrylate, 2-ethylhexyl methacrylate and functional derivatives of the methacrylates such as 2-hydroxyethyl methacrylate, 2-chloroethyl methacrylate and the like. The preferred methacrylate is methyl methacrylate.

The acrylamides and methacrylamides and each of their N-substituted alkyl and aryl derivatives include but are not limited to acrylamide, methacrylamide, N-methyl acrylamide, N, N-dimethyl acrylamide and the like.

The maleic acid monomers include but are not limited to maleic acid monododecyl maleate, didodecyl maleate, maleimide, N-phenyl maleimide.

The vinyl esters include but are not limited to vinyl acetate, vinyl propionate, vinyl butyrate and the like. The preferred vinyl ester is vinyl acetate.

The vinyl ethers include but are not limited to $C_1$ to $C_8$ vinyl ethers such as ethyl vinyl ether, butyl vinyl ether and the like.

The vinyl amides include but are not limited to vinyl pyrrolidone and the like.

The vinyl ketones include but are not limited to $C_1$ to $C_8$ vinyl ketones such as ethyl vinyl ketone, butyl vinyl ketone and the like.

The styrenes include but are not limited to substituted styrenes, multiply-substituted styrenes, methylstyrenes, styrene, indene and the like. Styrene is of the formula:

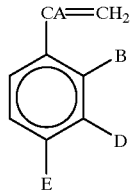

wherein each of A, B, D, and E is independently selected from hydrogen (H) and $C_1$ to $C_4$ alkyl groups.

The halogen containing monomers include but are not limited to vinyl chloride, vinyl bromide, vinyl fluoride, vinylidene chloride, vinylidene bromide, vinylidene fluoride, halogen substituted propylene monomers and the like. The preferred halogen containing monomers are vinyl chloride, vinyl bromide and vinylidene chloride.

The ionic monomers include but are not limited to sodium vinyl sulfonate, sodium styrene sulfonate, sodium methallyl sulfonate, sodium acrylate, sodium methacrylate and the like. The preferred ionic monomers are sodium vinyl sulfonate, sodium styrene sulfonate and sodium methallyl sulfonate.

The acid containing monomers include but are not limited to acrylic acid, methacrylic acid, vinyl sulfonic acid, itaconic acid, styrene sulfonic acid and the like. The preferred acid containing monomers are itaconic acid, styrene sulfonic acid and vinyl sulfonic acid.

The base containing monomers include but are not limited to vinyl pyridine, 2-aminoethyl-N-acrylamide, 3-aminopropyl-N-acrylamide, 2-aminoethyl acrylate, 2-aminoethyl methacrylate and the like.

The olefins include but are not limited to isoprene, butadiene, $C_2$ to $C_8$ straight chained and branched alpha-olefins such as propylene, ethylene, isobutylene, diisobutylene, 1-butene and the like. The preferred olefins are isobutylene, ethylene and propylene.

The high nitrile multipolymer does not contain any polymerized methacrylonitrile monomer.

The preferred multipolymer includes but is not limited to, an acrylonitrile monomer polymerized with at least one monomer of methyl acrylate, ethyl acrylate, vinyl acetate, methyl methacrylate, vinyl chloride, vinyl bromide, vinylidene chloride, sodium vinyl sulfonate, sodium styrene sulfonate, sodium methallyl sulfonate, itaconic acid, styrene sulfonic acid, vinyl sulfonic acid, isobutylene, ethylene, propylene and the like.

An exemplary method to make the melt processable high nitrile multipolymer is described in U.S. Pat. No. 5,618,901 entitled "A Process for Making a High Nitrile Multipolymer Prepared From Acrylontrile and Olefinically Unsaturated Monomers".

The high nitrile melt processable multipolymer is added to the melt extruder by itself or with small amounts of thermal stabilizer and/or processing aids. A pigment or a color concentrate can also be added to the extruder to produce pigmented fibers. The color concentrate comprises a polymeric carrier, a pigment and a surfactant(s). The pigment includes but is not limited to titanium dioxide, optical brighteners, carbon black, phthalocyanide blue and the like. The color concentrate is generally added at less than about 5%, preferably less than about 2% of the final fiber weight.

According to the present invention the high nitrile melt processable multipolymer with or without the color concentrate is heated to a melt by placing the multipolymer in a conventional extruder. The multipolymer is generally employed as a powder or a pellet. The multipolymer is extruded in the absence of solvent and in the absence of water. The multipolymer is extruded at a constant extrusion rate. The temperature is sufficient to achieve melt flow and is at a temperature higher than the glass transition temperature of the multipolymer. The molten multipolymer is then pumped through a gear pump, which meters the high nitrile multipolymer melt at a constant rate to a spinneret. The gear pump may or may not be heated. The spinneret typically has a filtering device to filter the melt and remove any impurities, contaminants, dust and the like prior to the melt going through the spinneret holes. The filtering device includes but is not limited to, screens, filters, sands and the like.

The extruded molten multipolymer goes through a spinneret(s) thereby forming filament(s). Conventionally, a manifold is used to connect the extruder to multiple spinnerets. The spinneret(s) has from one to multiple thousand holes. The spinneret with a single hole produces a monofilament and one with many thousands of holes produces a continuous filament bundle. The filament size (denier) is dependent upon the melt rate from the gear pump to the spinneret, the number of spinneret holes and the take up speed as stated in the following formula:

$$\text{denier per filament (dpf)} = \frac{(9{,}000)(\text{gear pump speed})(\text{gear pump capacity})(\text{melt density})}{(\text{take-up speed})(\text{number of holes in spinneret})}$$

Optionally, the spinneret can have a controlled atmosphere chamber. The controlled atmosphere chamber includes but is not limited to, a face plate, a heat shroud, quench air and the like. The controlled atmosphere chamber can be at room temperature, at a heated temperature or at a cooled temperature.

The present invention produces fibers with a predetermined cross-sectional profile, meaning the fibers cross-section reproduces the geometry of the spinneret hole. The shape of the filament cross-section is changed by employing any desired shaped spinneret hole. The shape of the cross-section of the profiled fibers of the instant invention include but are not limited to round, dog-bone, y-shaped, delta, trilobal, pentalobal, tetralobal, hexalobal, octalobal, rectangular, hollow and the like. The high nitrile fiber retains the cross-section shape of the spinneret hole resulting in an uniform and dimensionally stable profiled fiber.

The filaments from the spinneret are taken up as a fiber bundle at a fixed speed. A spin finish may be applied by typical methods such as a kiss roll, drip applicator and the like. The fiber bundle then proceeds to such other processing steps, as desired. The other processing steps can be done sequentially or intermittently. In one embodiment the fiber bundle is taken up on a winder resulting in as-spun fiber.

In another embodiment filaments from the spinneret are taken up on a roll. The term "roll" throughout this specification means Godet roll, roll, pins and other guiding devices. The fibers are oriented by successively drawing the filaments on one or more rolls at accelerated speeds. The draw that is imparted to the fiber is calculated by dividing the final roll speed by the initial roll speed. For example, if the initial roll is running at 200 meters per minute (mpm) and the final roll is running at 400 mpm, then the draw would be 400/200 equaling 2.0 or two times-draw (2×). A four x-draw would result from the final roll running at a speed that is four times faster than the initial roll.

In another embodiment the filaments are alternatively oriented by gravity or a blast of a high velocity of gas, air or the like co-axial as the filaments leave the spinneret. The oriented continuous filaments are collected in a random pattern and are converted into a non-woven web of continuous filaments. Alternatively, the velocity of the blast is such that the filaments break. The discontinuous filament pieces are collected and are converted into a non-woven web of pieces of filaments.

In another embodiment the filaments are heat set to relieve the internal stresses of the filaments. Heat setting may be affected either after orienting or after wind-up. Heat setting occurs by subjecting the filaments to a controlled atmosphere such as an oven, to a hot plate, to an infrared heater, to a heated roll, to a gaseous medium such as steam or the like, or combinations thereof. The filaments are heated in a temperature range from higher than the glass transition temperature (Tg) of the high nitrile multipolymer but less than the temperature to melt the high nitrile filaments. Heat setting may also be affected by passing the filaments through a heated medium while they lie relaxed on a conveyor belt after wind-up. If desired, heat setting may be carried out in a plurality of stages.

In another embodiment, the filaments are relaxed either after orienting, simultaneously with heat setting or after heat setting. The stretched filaments are relaxed by being taken from the roll to a relaxation roll at speeds less than the previous roll. The speed of the roll is set by the desired amount of relaxation of the filaments, so that the filaments relax. The fiber is at a temperature about or above the glass transition temperature of the fiber. The tension of the fiber is low enough for the fiber to relax a desired amount. The fiber is permitted to relax and shrink to a desired level.

Nearly all fibers undergo a form of texturizing prior to conversion into textiles. This facilitates making the synthetic fibers behave more like natural fibers as well as to increase their covering power. Conventional texturizing methods can be employed on the high nitrile fiber of the present invention such as crimping in a stuffer box; air turbulence; mechanical crimping such as passage over hot knife edge; passage between gear teeth; mechanically entangled; twisting; and the like.

Additional treatment of the filaments produced by the process described herein may be employed to further modify the characteristics of the high nitrile fiber so long as such steps do not have a deleterious effect on the properties of the high nitrile fibers. It would be readily apparent to one skilled in the art that the high nitrile fiber may be further modified by the use of various dyes, delustering agents, lubricants, adhesives and the like.

The continuous filament yarn is either cut to form staple the same or of different lengths or collected as continuous filament. Staple is used to make yarns suitable for weaving or knitting into fabrics. Staple or continuous filament may be used to make a non-woven web. Continuous filament is converted into yarn by any known process such as stretch-break and the yarn is woven or knitted into fabric.

SPECIFIC EMBODIMENT

The following examples demonstrate the process and advantages of the present invention.

Melt Spinning Process

The high nitrile fibers were spun on spinning equipment consisting of an extruder, pump block, metering gear pump, spinnerets, Godets/rolls and winder. The specific equipment used in these examples includes about a 1.5 inch, three zone extruder made by Sterling Extruder Corp., Linden, N.J.; a two stream gear pump either pump A delivering about 1.16 cc/revolution/stream or pump B delivering about 0.8 cc/revolution/stream, both made by Zenith, Waltham, Me. The twin melted multipolymer streams were then fed to twin filter packs and twin spinnerets. The take up for the combined fiber bundle included a kiss roll for a spin finish application, an adjustable speed take up Godet/roll, three adjustable speed Godets/rolls made by Fiber Science, Palm Bay, Fla. and a winder made by Leesona, Burlington, N.J.

The high nitrile multipolymer pellets were placed in a screw extruder and were then reduced to a melt. The molten high nitrile multipolymer melt was then pumped at constant extrusion rate from the gear pump to a filter pack cavity, passed through screens and then into the spinnerets at which point the filaments were formed as they exited the spinnerets. The filaments emerging from the spinnerets were passed over a convergence guide, received a spin finish, strung on the take-up roll and then wrapped on a bobbin winder.

Denier (Linear Density)

The average denier of the high nitrile fiber was determined by the ASTM D1577 test method. This method is a direct weighing of the fiber, yarn or bundle of fibers, containing a sufficient number of fibers, with a length of about 90 cm and is weighed on an analytical balance with a sensitivity of 0.001 mg. The average denier of a single high nitrile fiber is then calculated from the mass and length measurement on the yarn divided by the number of single fibers in the bundle as grams per 9000 meters.

Tenacity

Fiber tenacity or breaking point is determined according to ASTM D3822 test method. The breaking point/tenacity is calculated from the breaking load and the linear density (denier) of the unstrained high nitrile filaments placed in an Instron tensile machine and expressed as grams/denier.

Percent Elongation

The percent elongation of the high nitrile fiber is determined according to ASTM D3822 test method. The percent elongation corresponds to the maximum load of the fiber and is the increase in the length of the high nitrile fiber expressed as a percentage of the 10 mm gauge length.

Boiling Water Shrinkage Test

The boiling water shrinkage of the high nitrile fiber is determined according to ASTM D2102-90 test method. Two pieces of about a 90 cm length of high nitrile fiber is cut and the ends wrapped with about 7 mm of scotch tape. Each end of the taped high nitrile fiber specimen is placed in a clamp and is in a relaxed state. The clamped specimen is then exposed to a boiling water environment for about 1 to 2 minutes. The length is measured after cooling the specimen and the percentage of shrinkage calculated using the following formula:

$$\text{Shrinkage } \% = \{[L-S]/L\} \times 100$$

wherein

L=initial length of fiber specimen

S=length of fiber specimen after boiling/shrinkage

Color Test

The color of the fiber was determined on a Chroma Sensor CS5 spectrometer made by Data Color, Inc. of Lawrenceville, N.J. and reported according to The L*a*b* CIE 1976 procedure as described in General Optical Society, Vol. 64, pg. 896, 1976, and incorporated herein. In general the L* value represents color intensity on a scale of 0 to 100, with white=100 and black=0. The hues are represented by the a* and b* values on a Cartesian scale with +a being red; −a being green, +b being yellow; and −b being blue. A colorless white sample would have L*a*b* values of 100, 0, 0; while a pure black sample would have values of 0, 0, 0.

High Nitrile Multipolymer Compositions

Resin A

A high nitrile multipolymer resin comprising about 75% acrylonitrile (AN) and 25% methyl acrylate (MA) having a molecular weight (MW) of about 65,000 was melt spun at about 190° C. with gear pump A and a 48 hole spinneret with about a 0.8 mm/hole diameter and 4 length/diameter ratio (L/D). The winder take up speed was about 725 mpm.

Resin B/$B_1$

A high nitrile multipolymer resin comprising about 75% acrylonitrile and about 25% methyl acrylate having a MW of about 90,000 (B) was melt spun at about 200° C. with gear pump A. The spinneret had 48 holes with about a 0.8 mm/hole diameter and 4 L/D. The take up rate was about 725 mpm.

A second set of fibers ($B_1$) were produced with the same high nitrile multipolymer resin (B) and conditions except the winder take up speed was about 600 mpm.

Resin C

A high nitrile multipolymer resin comprising about 85% acrylonitrile and about 15% methyl acrylate having a MW of about 55,000 was melt spun at about 209° C. with gear pump A. The spinneret had 48 holes with about a 0.8 mm/hole diameter and 4 L/D. The winder take up speed was about 900 mpm.

Resin D

A high nitrile multipolymer resin comprising about 85% acrylonitrile and about 15% methyl acrylate having a MW of about 90,000 was melt spun at about 236° C. with gear pump B. The spinneret had 48 holes with about a 0.8 mm/hole diameter and 4 L/D. The winder take up speed was about 920 mpm.

Resin E

A high nitrile multipolymer resin comprising about 85% acrylonitrile and about 15% vinylacetate (VA) having a MW of about 55,000 was melt spun at about 210° C. with gear pump B. The spinneret had 48 holes with about a 0.8 mm/hole diameter and 4 L/D. The winder take up speed was about 1,000 mpm.

EXAMPLES

The denier, tenacity and percent elongation for resins A, B, $B_1$, C, D and E are shown in Table I below.

TABLE I

| Resin | Composition | dpf | Tenacity Single Filament (gpd) | % Elongation |
|---|---|---|---|---|
| A | 75AN/25MA | 3 | 4.7 | 22.3 |
| B | 75AN/25MA | 3 | 6.3 | 24.5 |
| $B_1$ | 75AN/25MA | 7.5 | 4.7 | 14 |
| C | 85AN/15MA | 3 | 2.5 | 18.3 |
| D | 85AN/15MA | 7.5 | 3.3 | 18.9 |
| E | 85AN/15VA | 5 | 3.5 | 20.7 |

Draw 1 Example

Resin C (85AN/15MA) having a MW of about 55,000 was melt spun at about 230° C. with gear pump A and a spinneret having 128 holes, 0.3 mm in diameter and 2 L/D. The speed of the four Godets of the take up were approximately 148/155/310/315 mpm, respectively, with the corresponding Godet temperatures of RT/80° C./RT/RT (RT= ambient temperatures).

The resulting filaments were 10 (dpf) with on-line drawing of 2/1. The tenacity and the elongation at break (%) of a single filament was 2.1 grams per denier (gpd) and 37.2%, respectively. The results are shown in Table II below.

Draw 2 Example

Resin C (85AN/15MA) was melt spun at about 216° C. with gear pump A and with a spinneret having 128 holes, 0.3 mm in diameter and 2 L/D. The corresponding four Godet speeds were approximately 148/155/620/625 mpm, respectively. The relative Godet temperatures were RT/80° C./RT/RT.

The resulting filaments were 5 dpf with on-line drawing of 4/1. The tenacity and elongation at break (%) of the single filament were 3.4 gpd and 24.7%, respectively. The results are shown in Table II below.

No Draw Example

Resin C (85 AN/15 MA) was melt spun at about 213° C. with gear pump A and with a spinneret having 128 holes, 0.3 mm diameter and 2 L/D. The corresponding four Godet speeds were approximately 200/205/210/215 mpm, respectively. The relative Godet temperatures were RT/RT/RT/RT.

The resulting filaments were 20 dpf with no on-line drawing. The results are shown in Table II below.

TABLE II

| Example | Draw | dpf | Tenacity Single Filament (gpd) | % Elongation |
|---|---|---|---|---|
| 1 | 2 X | 10 | 2.1 | 37.2 |
| 2 | 4 X | 5 | 3.4 | 24.7 |
| no draw | none | 20 | 1.1 | 22.0 |

Heat Set Example

Resin C (85AN/15MA) having a MW of about 55,000 was melt spun at about 224° C. with gear pump A, and a spinneret of 48 holes, 0.8 mm in diameter and 4 L/D. The four Godet rolls had take-up speeds of approximately 845/850/820/820 mpm, respectively. The corresponding Godet roll temperatures were RT/120° C./130° C./RT.

The resulting filaments were 6 dpf with the heat set in the range of about 120° C. to about 130° C. and had about 3.5% relaxation. The tenacity and elongation at break (%) of the single filaments were 2.4 gpd and 30.4%, respectively. The boiling water shrinkage of the heat set filament was improved by 25%. The results are shown in Table III below.

TABLE III

| Heat Set ° C./% relax | dpf | Tenacity Single Filament (gpd) | % Elongation | Boiling Water Shrinkage |
|---|---|---|---|---|
| none | 6 | 2.2 | 25.8 | 21–23 |
| 120–130/3.5 | 6 | 2.4 | 30.4 | 14–16 |

Pigment Colored Fiber Examples

Three color pigments were compounded separately into a high nitrile multipolymer resin containing about 75% acrylonitrile and about 25% methyl acrylate with a MW of about 60,000 to make a color concentrate resin. The pigments used were titanium dioxide, 10%; phthalocyanide blue, 15%; and carbon black, 5% and 35%; by weight pigment, respectively. The concentrates were in pellet form. Each concentrate was blended with unpigmented resin of the same composition and molecular weight and melt spun into fiber as per resin A. The results are shown in the Table IV below.

The examples demonstrate that the fibers have the expected color. The blue pigmented fiber has a −30 "b" value and a −16 "a" value, which is a blue shade with a green tinge and is smaller than the "b" value meaning blue dominates and the L is 50 which means it is a medium blue color. The white pigmented fiber has high L values and low "a" and "b" values which is what is expected for white. The black pigmented fibers has a low "L" value and low "a" and "b" values which is what is expected for black.

TABLE IV

| Color | Pigment (wt % in fiber) | L* | a* | b* |
|---|---|---|---|---|
| Natural | none | 91.99 | −1.07 | 12.40 |
| Blue | 0.4 | 59.12 | −16.01 | −30.29 |
| White | 0.4 | 91.40 | −0.50 | 10.85 |
| White | 0.8 | 91.87 | −0.48 | 11.64 |

TABLE IV-continued

| Color | Pigment (wt % in fiber) | L* | a* | b* |
|---|---|---|---|---|
| Black (5%) | 0.2 | 35.38 | 1.03 | 3.77 |
| Black (35%) | 1.0 | 18.78 | 0.30 | 0.80 |

Profile Example

A high nitrile multipolymer resin comprising about 75% acrylonitrile and 25% methacrylate having a molecular weight of about 65,000 was melt spun at 190° C. with gear pump B, and a 128 hole trilobal spinneret. The 128 hole trilobal die was constructed with each individual hole consisting of three slots, each 0.315 mm long by 0.140 mm wide, joined at one end to a single point. Each hole was a symmetrically "Y-shaped" with an angle of 120° between each arm. The depth of each hole was 0.5 mm.

The fiber cross-section produced from the die was a three pointed star with three sharp points radiating symmetrically from the center as viewed by an optical microscope. The multilobal fiber was tested and the results are shown in Table V below. The data demonstrates that the shaping of the fiber does not adversely affect the fiber properties. The fiber has good tenacity and elongation after shaping.

TABLE V

| Example 75AN/25MA | dpf | Tenacity single filament | % Elongation |
|---|---|---|---|
| 1 | 9 | 1.7 | 32.3 |
| 2 | 4.5 | 2.8 | 31.0 |
| 3 | 3 | 2.7 | 21.7 |

From the above description and examples of the invention those skilled in the art will perceive improvement, changes and modification in the invention. Such improvements, changes and modifications within the skill of the art are intended to be covered by the appended claims.

What is claimed:

1. A high nitrile fiber comprising about 85% to about 92% by weight polymerized acrylonitrile monomer and about 8% to about 15% by weight copolymerized olefinically unsaturated monomer wherein the high nitrile fiber is produced via melt processing in the absence of water and in the absence of other solvents.

2. The nitrile fiber of claim 1 wherein said olefinically unsaturated monomer is selected from the group consisting of acrylates, methacrylates, acrylamide and its derivatives, methacrylamide and its derivatives, maleic acid and its derivatives, vinyl esters, vinyl ethers, vinyl amides, vinyl ketones, styrenes, halogen containing monomers, ionic monomers, acid containing monomers, base containing monomers, olefins and combinations thereof.

3. The nitrile fiber of claim 1 wherein said olefinically unsaturated monomer is selected from the group consisting of methyl acrylate, ethyl acrylate, methyl methacrylate, vinyl acetate, ethyl vinyl ether, butyl vinyl ether, vinyl pyrrolidone, ethyl vinyl ketone, butyl vinyl ketone, methyl styrene, styrene, indene, vinyl bromide, vinylidene chloride, sodium vinyl sulfonate, sodium styrene sulfonate, sodium methallyl sulfonate, itaconic acid, styrene sulfonic acid, vinyl sulfonic acid, vinyl pyridine, 2-amino ethyl-N-acrylamide, 3-aminopropyl-N-acrylamide, 2-aminoethyl acrylate, 2-aminoethyl methacrylate, propylene, ethylene, isobutylene, and combinations thereof.

4. The nitrile fiber of claim 1 wherein said olefinically unsaturated monomer is selected from the group consisting of methyl acrylate, ethyl acrylate, vinyl acetate, methyl methacrylate, vinyl chloride, vinyl bromide, vinylidene chloride, sodium vinyl sulfonate, sodium styrene sulfonate, sodium methallyl sulfonate, itaconic acid, styrene sulfonic acid, vinyl sulfonic acid, isobutylene, ethylene, propylene and combinations thereof.

5. The nitrile fiber of claim 1 wherein the fiber is processed into a staple, a continuous filament, a knitted fabric, a woven fabric, a non-woven mat or combinations thereof.

6. The nitrile fiber of claim 1 wherein neither the fiber nor the precursor polymer experience thermal degradation prior to or during the waterless, solventless, melt processing.

7. A high nitrile fiber consisting essentially of about 50% to about 95% by weight polymerized acrylonitrile monomer and about 5% to about 50% by weight copolymerized olefinically unsaturated monomer wherein the olefinically unsaturated monomer is selected from the group consisting of methyl acrylate, ethyl acrylate, methyl methacrylate, vinyl acetate, ethyl vinyl ether, butyl vinyl ether, vinyl pyrrolidone, ethyl vinyl ketone, butyl vinyl ketone, methyl styrene, styrene, indene, vinyl bromide, vinylidene chloride, sodium vinyl sulfonate, sodium styrene sulfonate, sodium methallyl sulfonate, itaconic acid, styrene sulfonic acid, vinyl sulfonic acid, vinyl pyridine, 2-amino ethyl-N-acrylamide, 3-aminopropyl-N-acrylamide, 2-aminoethyl acrylate, 2-aminoethyl methacrylate, C2 to C8 straight chained alpha-olefins, and combinations thereof; and wherein the high nitrile fiber is produced via melt processing in the absence of water and in the absence of other solvents.

8. The nitrile fiber of claim 7 wherein the fiber is processed into a staple, a continuous filament, a knitted fabric, a woven fabric, a non-woven mat or combinations thereof.

9. The nitrile fiber of claim 7 wherein neither the fiber nor the precursor polymer experience thermal degradation prior to or during the waterless, solventless, melt processing.

10. A high nitrile fiber consisting essentially of about 50% to about 95% by weight polymerized acrylonitrile monomer and about 5% to about 50% by weight copolymerized olefinically unsaturated monomer wherein the olefinically unsaturated monomer is selected from the group consisting of methyl acrylate, ethyl acrylate, methyl methacrylate, vinyl acetate, ethyl vinyl ether, butyl vinyl ether, vinyl pyrrolidone, ethyl vinyl ketone, butyl vinyl ketone, indene, vinyl bromide, vinylidene chloride, sodium vinyl sulfonate, sodium styrene sulfonate, sodium methallyl sulfonate, itaconic acid, vinyl sulfonic acid, vinyl pyridine, 2-amino ethyl-N-acrylamide, 3-aminopropyl-N-acrylamide, 2-aminoethyl acrylate, 2-aminoethyl methacrylate, C2 to C8 straight chained and branched alpha-olefins, isobutylene, diisobutylene, and combinations thereof; and wherein the high nitrile fiber is produced via melt processing in the absence of water and in the absence of other solvents.

11. The nitrile fiber of claim 10 wherein the fiber is processed into a staple, a continuous filament, a knitted fabric, a woven fabric, a non-woven mat or combinations thereof.

12. The nitrile fiber of claim 10 wherein neither the fiber nor the precursor polymer experience thermal degradation prior to or during the waterless, solventless, melt processing.

* * * * *